US006852008B2

(12) United States Patent
Sato

(10) Patent No.: US 6,852,008 B2
(45) Date of Patent: Feb. 8, 2005

(54) METHOD AND APPARATUS FOR DISCHARGING WORKS FROM A CENTERLESS GRINDER

(75) Inventor: Toshiaki Sato, Tochigi-ken (JP)

(73) Assignee: Nippon Piston Ring Co., Ltd., Saitama (JP)

( * ) Notice: Subject to any disclaimer, the term of this patent is extended or adjusted under 35 U.S.C. 154(b) by 90 days.

(21) Appl. No.: 10/255,947

(22) Filed: Sep. 27, 2002

(65) Prior Publication Data

US 2003/0064672 A1 Apr. 3, 2003

(30) Foreign Application Priority Data

Sep. 28, 2001 (JP) ..... 2001-300922

(51) Int. Cl.[7] ..... B24B 47/02
(52) U.S. Cl. ..... 451/28; 451/339
(58) Field of Search ..... 451/28, 339, 407, 451/436, 438, 460, 335, 337, 333

(56) References Cited

U.S. PATENT DOCUMENTS 3,807,097 A * 4/1974 Druge ..... 451/335
3,817,008 A * 6/1974 Egusa et al. ..... 451/335
4,209,087 A * 6/1980 Kushigian ..... 451/339
4,665,659 A * 5/1987 Schwar et al. ..... 451/339
5,231,798 A * 8/1993 Judge et al. ..... 451/339
5,554,063 A * 9/1996 Millay et al. ..... 451/407
6,113,461 A * 9/2000 Onoda et al. ..... 451/5

FOREIGN PATENT DOCUMENTS

| | | |
|---|---|---|
| GB | 2 079 649 A | 1/1982 |
| JP | 08019940 A | 1/1996 |
| SU | 1159759 A | 6/1985 |

* cited by examiner

*Primary Examiner*—Hadi Shakeri
(74) *Attorney, Agent, or Firm*—Birch, Stewart, Kolasch, & Birch, LLP

(57) ABSTRACT

A method and apparatus for discharging work product from a device wherein a roller which is biased to push against the top of the work product cooperates with a stopper which engages the surface of the work product for displacing the work product, one-by-one from the device to a discharge chute.

10 Claims, 3 Drawing Sheets

METHOD AND APPARATUS FOR DISCHARGING WORKS FROM A CENTERLESS GRINDER

FIELD OF THE INVENTION

The present invention relates to a method and apparatus for discharging works from a centerless grinder, particularly to a method and apparatus for discharging axially-thin works from a centerless grinder, where the works are through-fed to the centerless grinder, processed with grinding therein, aligned axially in a horizontal direction on a guide plate disposed on the discharging side of the centerless grinder, and pushed out of the discharging end (or front end) of the guide plate by means of a thrust force provided during the grinding and falling onto a discharge chute disposed below, by means of their own weight.

BACKGROUND OF THE INVENTION

An apparatus is disclosed in Japanese patent Unexamined Publication Toku-Kai-Hei (JP(A)) 8-19940, where, after axially-thin works are through-fed to a centerless grinder and processed with grinding therein, the works are aligned axially along the horizontal direction on a guide plate, and pushed out of the discharging end (or front end) of the guide plate by means of a thrust force provided during the grinding, to fall onto a discharge chute disposed below, by means of their own weight. The works are then conveyed by means of the discharge chute into a laser measuring device, where the works are passed through the laser measuring device in a radial direction to measure the outer diameter of the works for quickly feeding back the measuring results to the centerless grinder. In the method and apparatus for discharging works from a centerless grinder, as disclosed in the Japanese patent Unexamined Publication, the works processed with grinding are aligned axially in a horizontal direction, on a guide plate disposed on the discharging side of the centerless grinder, and by means of a thrust force provided during the grinding is caused to fall radially in the vertical direction, piece by piece, out of the discharging end (or front end) of the guide plate utilizing air and their own weight, to be collected onto a discharge chute disposed below.

The disclosed apparatus has the disadvantage in that, while the axially-thin works ground and aligned on the guide plate disposed on the discharging side of the centerless grinder, and pushed out of the front end of the guide plate by means of a thrust force provided during the grinding, neighboring works tend to be engaged with each other by means of grinding burrs, whereby, if the grinding speed is increased, it becomes difficult to cause the works to fall, piece by piece, radially in the vertical direction, by means of flowing air and their own weight, as the works are coming out of the front end of the guide plate, with a high probability that two neighboring works fall together. When two works fall together, the discharge chute is clogged with the works resulting in the transportation of the works to the measuring device being stopped. Then the works in the grinding process is caused to undergo processing for an excessive period of time, and, in turn, become defective. Once this condition occurs, the centerless grinder must be temporarily stopped for discharging all of the unfinished works, and then restarted, which causes loss due to deterioration in yield and availability.

While a method is being implemented including the steps of causing works to fall vertically in the radial direction of the works by pressing downward on the works being pushed out of the front side of the guide plate by means of a roller energized (given force) vertically downward with a spring, instead of flowing air, such steps have not succeeded in solving the problem whereby two neighboring works pushed out of the guide plate tend to fall together, when the grinding speed is increased.

The present invention has been made to solve this problem. Accordingly, an object of the present invention is to provide a method and apparatus for discharging works from a centerless grinder where the works, ground and being pushed axially along the horizontal direction out of a guide plate disposed on the discharging side of the centerless grinder are caused to fall, piece by piece, radially in the vertical direction, even when the grinding speed is increased.

SUMMARY OF THE INVENTION

In order to accomplish the object described above, the present invention provides a method and apparatus for discharging works from a centerless grinder, wherein the works are through-fed to the centerless grinder, processed with grinding therein, aligned axially along the horizontal direction on a guide plate disposed on the discharging side of the centerless grinder, and pushed out of the front end of the guide plate by means of a thrust force provided during the grinding, whereby the works are caused to fall, by means of their own weight onto a discharge chute disposed below. With the method and apparatus according to the present invention, the upper end of the circumferential surface of a preceding or front work of the works being pushed out of the guide plate is pressed downward vertically by means of a roller energized (given force) with a spring, and the preceding work having been completely pushed out of the guide plate is brought in contact with the contact surface of a stopper that hangs in front of the front end of the guide plate and swingably mounted in the direction of the works being pushed out, whereby the preceding work is caused to fall. The stopper is adapted not to swing in the case where only the preceding work has been completely pushed out of the front end of the guide plate. The stopper is adapted to swing in the case where one following work of the works, that is immediately following the preceding work, is being pushed out of the front end of the guide plate together with the preceding work, whereby the horizontal component force from the stopper, caused by the swinging motion, resists the following work from being pushed out of the front end of the guide plate, by means of the contact surface of the stopper, and prevents the following work from being pushed out together with the preceding work.

Thus, in the case where the following work is being pushed out of the front end of the guide plate before the preceding work having been completely pushed out of the front end of the guide plate is caused to fall, the stopper is pushed away to swing. This swinging motion causes the horizontal component force in the stopper to push back the following work, Namely, the horizontal component force causes the contact surface of the stopper to press back the front end surface of the preceding work, which in turn pushes back the following work and prevents the following work from having been completely pushed out of the front end of the guide plate before the preceding work is caused to fall. This consequently prevents the two neighboring works from being discharged and falling together.

Preferably, according to one aspect of the present invention, a stand is disposed standing near the front end of the guide plate, where the stand has an adjustable lever fixed thereto, by means of a double holder. The lever includes a rocking center, one end on the side of the front end of the guide plate, and the opposite end, whereby the lever is fixed with the vertical position and the rocking center position of the lever being adjustable. The lever has a roller provided at one end thereof and is rotatably pivoted by a spring disposed at the opposite end thereof which energizes the roller to vertically press down on the work being pushed out of the guide plate, in the radial direction of the work by placing the roller on the upper end of the circumferential surface of the work coming out of the front end of the guide plate. The roller is arranged to have the axis of the roller positioned in the same vertical plane as the front end surface of the preceding work that has been completely pushed out of the guide plate, and is arranged to have the lower end of the roller positioned slightly lower than the upper end of the circumferential surface of the preceding work before completely pushed out from the guide plate, respectively.

Furthermore, preferably, according to another aspect of the present invention, the stand is disposed standing near the front end of the guide plate, where the stand has a bracket fixed thereto. The bracket has the upper front end thereof extended upward, with the upper end of the stopper swingably pivoted on the upper front end of the bracket. The stopper has the lower end thereof equipped with a contact surface that makes light contact, under free conditions, with the front end of the preceding work that has been completely pushed out of the guide plate. The stopper has the lower end thereof further extended downward to form a guide surface approximately in parallel with the discharge chute. Under the free conditions, the stopper is arranged to have the contact surface thereof positioned in the same vertical plane as the front end surface of the preceding work that has been completely pushed out of the guide plate.

With method and apparatus for discharging works from a centerless grinder implemented as described above, advantages are effected in that the following work of a plurality of works, that is immediately following the preceding work, is prevented from falling together with the preceding work, in the case where the following work of the plurality of works is being pushed out of the front end of the guide plate together with the preceding work. This is effected because the two neighboring works, i.e., the preceding and following works, being pushed out together, cause the stopper in contact with the front end surface of the preceding work to swing away from the front end of the guide plate, which in turn causes a swing back motion, creating a horizontal component force on the contact surface which resists to the works from being pushed out, whereby the following work is prevented from being pushed out until the preceding work falls down.

Other objects and advantages of the present invention may become more apparent by referring to the following detailed description and accompanying drawings briefly described below.

DETAILED DESCRIPTION OF THE INVENTION

Figure 1:
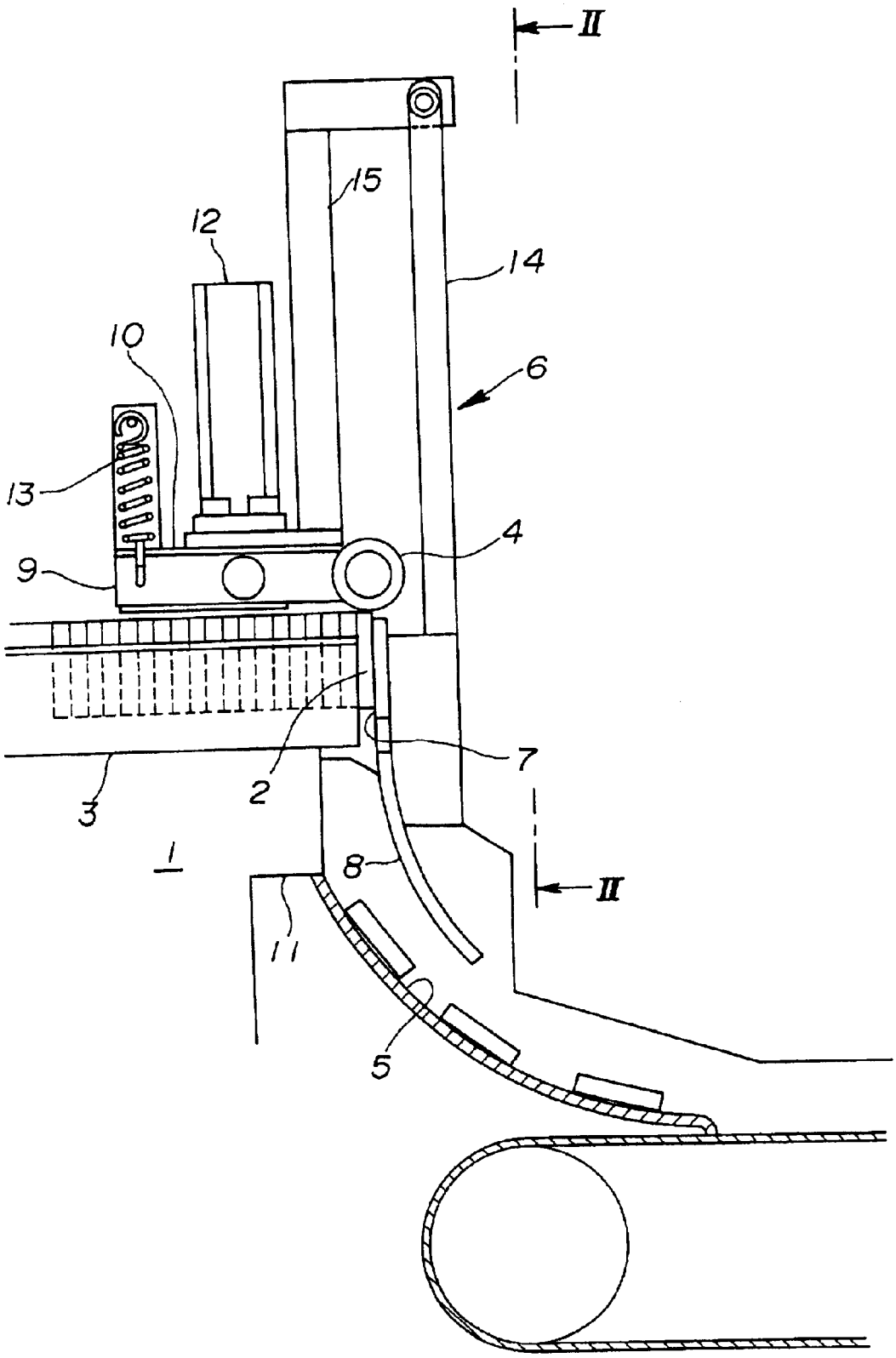
FIG. 1 is an elevation view partially in section, of a major portion of a centerless grinder equipped with an apparatus, according to an embodiment of the present invention.
Figure 2:
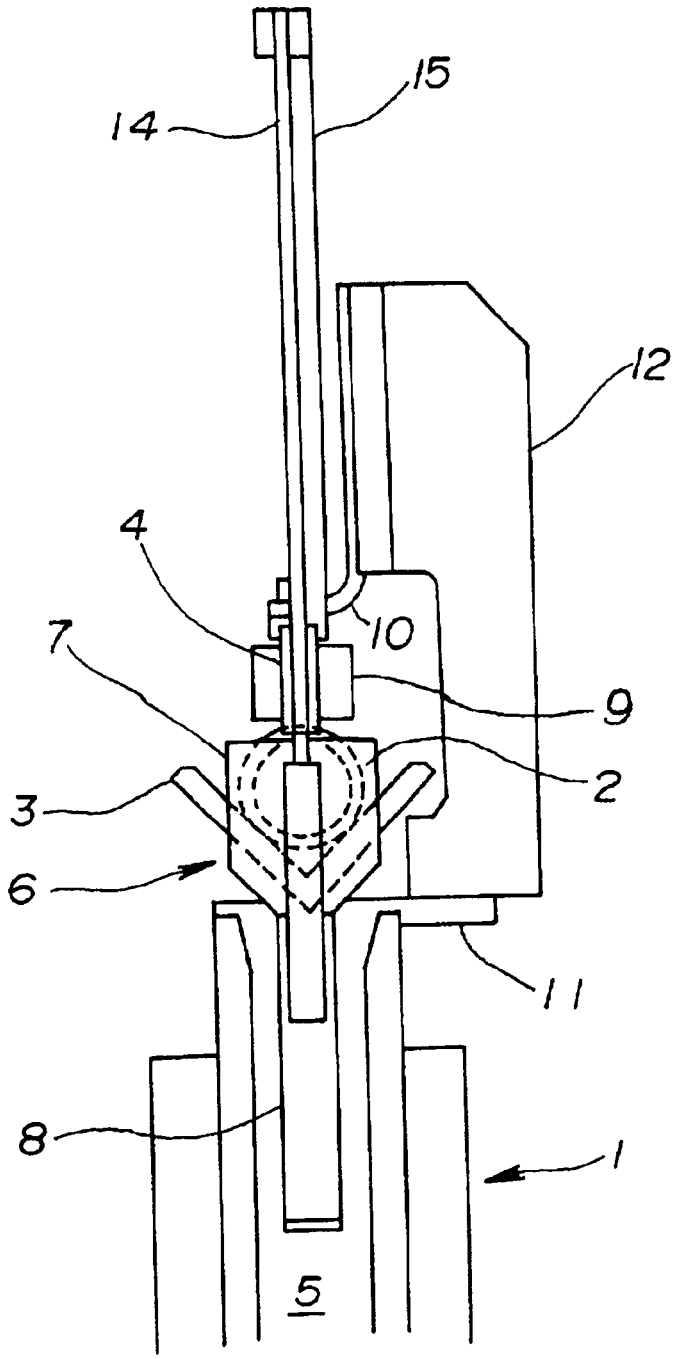
FIG. 2 is an outside view along arrow lines II—II of FIG. 1.

The method and apparatus of the present invention will be described hereunder according to an embodiment shown in the Figures. FIG. 1 is an elevational view, partially in section, of a major portion of a centerless grinder equipped with an apparatus, according to an embodiment of the present invention, and FIG. 2 is an outside view taken along arrow lines II—II of FIG. 1.

In a centerless grinder 1, axially-thin work product is through-fed to the centerless grinder, processed with grinding therein, aligned axially in the horizontal direction on a guide plate 3 disposed on the discharging side of the centerless grinder 1, and pushed out of the front end of the guide plate 3 by means of a thrust force provided during the grinding operation.

As the upper end of the circumferential surface of a preceding work 2 of the work product being pushed out of the guide plate 3 is pressed downward, vertically in the radial direction by means of a roller 4, the preceding work 2 is caused to fall by means of its own weight, to be discharged onto a discharge chute 5 below. In this case, the front end of the preceding work 2 having been completely pushed out of the guide plate 3 is brought into light contact with the contact surface 7 of a stopper 6 that is disposed in front of the front end of the guide plate 3, because the stopper 6 is in a free position.

The roller 4 is rotatably pivoted at one end of a lever 9. The lever 9 is rockably pivoted on a double holder 10. The double holder 10 is fixed to a stand 12 with the vertical and horizontal positions of the double holder 10 against the stand 12 made adjustable, where the stand 12 is disposed standing on a frame 11 of the centerless grinder 1. The lever 9 has a spring 13 disposed between the opposite end of the lever 9 and the double holder 10, to energize, or provide force to, the roller 4 downward in the vertical direction.

An arm 14 is extended upward in the vertical direction from the contact surface 7 of the stopper 6, where the upper end of the arm 14 is swingably pivoted on the upper end of the bracket 15. The double holder 10 has its vertical and horizontal positions against the stand 12 adjusted, so that the roller 4 is arranged to have the axis thereof positioned in the same vertical plane as containing the front end surface of the preceding work 2 having been completely pushed out of the guide plate 3, and is arranged to have the lower end thereof positioned slightly lower than the upper end of the circumferential surface of the preceding work 2 before the preceding work 2 has been completely pushed out of the guide plate 3, and the stopper 6 is arranged to have the contact surface 7 thereof positioned in the same vertical plane to contain the front end surface of the preceding work 2 that has been completely pushed out of the guide plate 3, respectively.

Figure 3:
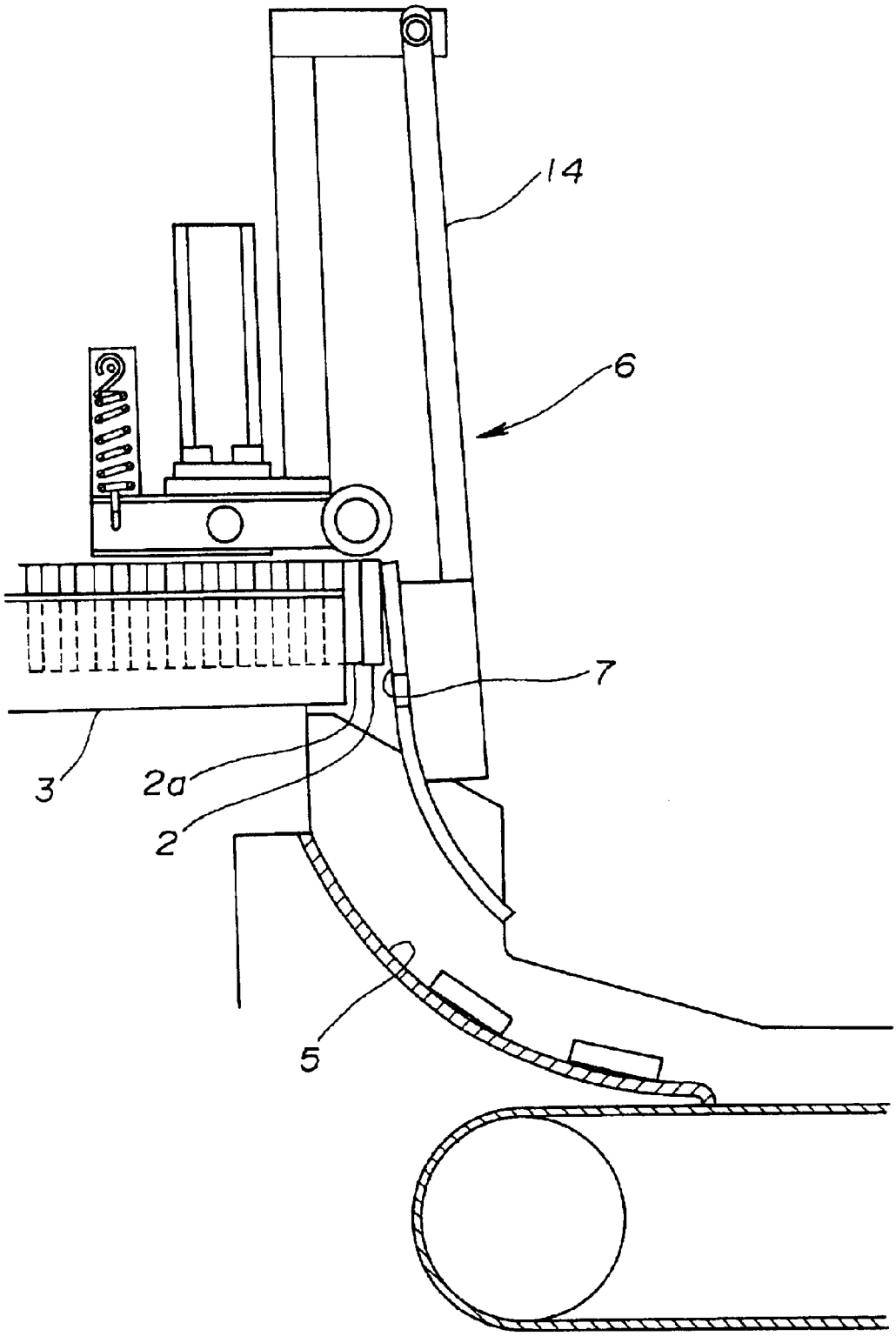
FIG. 3 is an elevation view corresponding to the elevation view partly in section of a major portion of a centerless grinder equipped with an apparatus, according to an embodiment of the present invention of FIG. 1, showing how the work product is prevented from being discharged in double, i.e., together.

As shown in FIG. 3, in the case where a following work 2*a* that is immediately following the preceding work 2 is coming out of the front end of the guide plate 3 before the preceding work 2 has fallen, the contact surface 7 of the stopper 6 is contacted and pushed backward, or in the direction of works 2, 2*a* being pushed out of the front end of the guide plate 3, by the front end surface of the preceding work 2, which in turn causes the arm 14 to swing from its free position, thereby generating horizontal component force that pushes back the preceding work 2. This pushing-back component force is substantially proportional to the length by which the following work 2*a* protrudes from the front end of the guide plate 3, and is arranged to resist the following work 2*a* being pushed out of the guide plate 3. Thus, the following work 2*a* is not able to completely push out of the guide plate 3. In the meantime, upon having been completely pushed out of the guide plate 3 and pressed downward by the energized roller 4, the preceding work 2, falls downward along the contact surface 7 by means of its own weight. Therefore, the problem of the double discharging of works is prevented from occurring whereby the preceding, or front work and the following work fall together.

The method and apparatus of the present invention exhibits outstanding advantageous effects when applied to cases of discharging from a centerless grinder, works having the axial thickness far smaller than the outer diameter, as shown in FIGS. 1 and 3, including thin-thickness works, such as valve sheets, and miniature bearing rings.

While ring-shaped works are shown in the figures referred to in the description above according to the present invention, the method and apparatus of the present invention can be applied to works other than ring-shaped, such as disk-shaped works, works having an axially recessed groove, works having an axially arc-shaped groove, and works of axially stepped shape.

With the method and apparatus for discharging works from a centerless grinder implemented as described above, outstanding advantages are effected in that the following work, that is that work immediately following the preceding or front work, is prevented from falling together with the preceding work, in the case where the following work is being pushed from the front end of the guide plate together with the preceding work, as contrasted with conventional methods and apparatus which are unable to prevent two neighboring works from falling together. This is so effected because, if the following work is pushed out of the front end of the guide plate together with the preceding work before the preceding work, having been completely pushed out, is caused to fall, the stopper, in contact with the front end surface of the preceding work, is caused to swing from its free position, which in turn causes a swing back motion, originating in a horizontal component force on the contact surface resisting and pushing back the works, whereby the following work is prevented from being completely pushed out until the preceding work falls down.

Furthermore, because two neighboring works are not likely to fall together even when the processing speed of a centerless grinder is made greater than before, the present invention exhibits extraordinary effects in that such increase in the processing speed of a centerless grinder may enhance productivity and reduce processing cost.

While there have been shown and described fundamental novel features of the invention as applied to preferred embodiments thereof, it will be understood that various modifications and changes to such embodiments may be made by those skilled in the art without departing from the spirit of the invention. It is our intention, therefore, to be limited only as indicated by the scope of the claims appended hereto.

What is claimed is:

1. A method for discharging works from a centerless grinder, wherein said works are through-fed to said centerless grinder, processed with grinding therein, aligned axially along a horizontal direction on a guide plate disposed at a discharging side of said centerless grinder, and pushed from a front end of said guide plate by means of a thrust force provided during the grinding, whereby said works are caused to fall, by means of their own weight onto a discharge chute disposed therebelow which comprises:

(a) pressing downward vertically on an upper end of the circumferential surface of a preceding work of said works being pushed from said guide plate by means of a roller energized with a spring, and (b) causing said preceding work that has been completely pushed from said guide plate to fall, while bringing the front end of said preceding work that has been completely pushed from said guide plate into contact with a contact surface of a stopper that hangs in front of said front end of said guide plate, swingable in the direction of said works being pushed out, wherein said stopper is arranged to have the contact surface positioned in the same vertical plane as the front surface of the preceding work that has been completely pushed from said guide plate through an arm extending in the vertical direction from the contact surface to be swingably pivoted on the upper end of a bracket, whereby said stopper makes no swinging motion in the case where only said preceding work has been completely pushed from said front end of said guide plate, and said stopper makes a swinging motion in the case where one following work of said works, that is immediately following said preceding work is pushed from said front end of said guide plate together with said preceding work so that said following work is prevented from being pushed out together with said preceding work by a horizontal component force caused by said swinging motion.

2. A method for discharging works from a centerless grinder according to claim 1, wherein said roller has an axis thereof positioned in a same vertical plane as said front end surface of said preceding work that has been completely pushed from said guide plate, and said roller has a lower end thereof positioned slightly lower than the upper end of the circumferential surface of said preceding work before having been completely pushed from said guide plate.

3. A method for discharging works from a centerless grinder according to one of claims 1 and 2, wherein said stopper has said contact surface thereof positioned in the same vertical plane as said front end surface of said preceding work that has been completely pushed from said guide plate.

4. An apparatus for discharging works from a centerless grinder, said works being through-fed to said centerless grinder, processed with grinding therein, aligned axially in a horizontal direction on a guide plate disposed at the discharge side of said centerless grinder, and pushed from the front end of said guide plate by means of a thrust force provided during the grinding causing the works to fall by their own weight, onto a discharge chute, said apparatus comprising:

(A) a roller for pressing downward, vertically on an upper end of the circumferential surface of a preceding work of said works being pushed from said guide plate, and (B) a stopper equipped with a contact surface for making contact with the front end of said preceding work that has been completely pushed from said guide plate, said stopper pivotably extending to the front end of said guide plate to swing in the direction of said works being pushed from the guide plate, said stopper is arranged to have the contact surface positioned in the same vertical plane as the front surface of the preceding work that has been completely pushed from said guide plate through an arm extending in the vertical direction from the contact surface to be swingably pivoted on the upper end of a bracket, whereby said stopper makes no swinging motion in the case where only said preceding work has been completely pushed from said front end of said guide plate, and said stopper makes a swinging motion in the case where one following work of said works, that is immediately following said preceding work is pushed from said front end of said guide plate together with said preceding work so that said following work is prevented from being pushed out together with said preceding work by a horizontal component force caused by said swinging motion.

5. The apparatus for discharging works from a centerless grinder according to claim 4, including a stand disposed near said front end of said guide plate, said stand having a lever pivotably mounted thereto and extending to the front end of said guide plate said roller being mounted at said front end, and a spring operatively connected to said lever for energing said roller to press down on said preceding work being pushed from said guide plate.

6. An apparatus for discharging works from a centerless grinder according to claim 5 including a stand disposed near said front end of said guide plate having a bracket fixed thereto, said bracket extending upward, said bracket having an upper end on which said stopper is swingably pivoted, said stopper having the lower end thereof equipped with said contact surface for making light contact with said front end of said preceding work that has been completely pushed from said guide plate, said stopper having a lower end thereof further extended downward to form a guide surface substantially parallel with said discharge chute.

7. An apparatus for discharging works from a centerless grinder according to claim 4, including a stand disposed near said front end of said guide plate, said stand having a bracket fixed thereto, said bracket extending upward, said bracket having an upper end on which said stopper is swingably pivoted, said stopper having the lower end thereof equipped with said contact surface for making light contact, under free conditions, with said front end of said preceding work that has been completely pushed from said guide plate, said stopper having a lower end thereof further extended downward to form a guide surface substantially parallel with said discharge chute.

8. An apparatus for discharging works from a centerless grinder according to one of claims 4–6, wherein said roller has an axis thereof positioned in a same vertical plane as said front end surface of said preceding work that has been completely pushed from said guide plate, and said roller has a lower end thereof positioned slightly lower than the upper end of the circumferential surface of said preceding work before being completely pushed from said guide plate.

9. The apparatus for discharging works from a centerless grinder according to claim 8, wherein said stopper has the contact surface thereof positioned in a same vertical plane as said front end surface of said preceding work that has been completely pushed out of said guide plate.

10. The apparatus for discharging works from a centerless grinder according to one of claims 4–6, wherein said stopper has the contact surface thereof positioned in a same vertical plane as said front end surface of said preceding work that has been completely pushed from said guide plate.

* * * * *